US007367065B2

(12) United States Patent
Gregg

(10) Patent No.: US 7,367,065 B2
(45) Date of Patent: May 6, 2008

(54) FACIAL HAIR TRIMMINGS CATCHER

(76) Inventor: Steven Ross Gregg, 555 Spring Park Center Blvd. #4102, Spring, TX (US) 77373

( * ) Notice: Subject to any disclaimer, the term of this patent is extended or adjusted under 35 U.S.C. 154(b) by 161 days.

(21) Appl. No.: 11/254,375

(22) Filed: Oct. 20, 2005

(65) Prior Publication Data

US 2007/0101472 A1 May 10, 2007

(51) Int. Cl.
*A41D 13/04* (2006.01)

(52) U.S. Cl. ..... 2/50; 2/46

(58) Field of Classification Search ..... 2/48, 2/46, 49.2, 50, 51, 52, 174, 49.1, 49.3, 468; 383/33, 34, 43; 4/484, 521; 150/900, 120, 150/118, 110; 132/215, 289, 333, 212
See application file for complete search history.

(56) References Cited

U.S. PATENT DOCUMENTS 677,010 A * 6/1901 Ziller ..... 2/49.2
879,124 A * 2/1908 Thompson ..... 2/49.2
996,084 A * 6/1911 Herring ..... 2/49.2
1,516,590 A 11/1924 Dorsey
2,199,334 A 4/1940 Ferry
2,469,835 A * 5/1949 McMartin ..... 2/49.3
2,697,222 A * 12/1954 Reid ..... 2/49.2
2,943,660 A 7/1960 Seeger
3,407,407 A * 10/1968 Hollander et al. ..... 2/49.2
4,649,572 A * 3/1987 Roessler ..... 2/49.2
4,689,830 A 9/1987 Williams
4,862,518 A 9/1989 Williams
4,887,315 A * 12/1989 Bezdek ..... 2/46
4,985,932 A * 1/1991 Bezdek ..... 2/49.2
5,112,322 A 5/1992 Hathaway
5,647,670 A 7/1997 Iscovich
5,671,479 A * 9/1997 Dedrick ..... 2/46
5,950,236 A * 9/1999 Andrew et al. ..... 2/50
6,101,632 A 8/2000 Veazey
6,105,165 A * 8/2000 Johnson et al. ..... 2/49.2
6,401,246 B1 6/2002 Perez
6,874,936 B2 * 4/2005 Gillis et al. ..... 383/22
6,908,148 B2 6/2005 Wang

* cited by examiner

*Primary Examiner*—Amy B. Vanatta
(74) *Attorney, Agent, or Firm*—Dale J. Ream

(57) ABSTRACT

A facial hair trimmings catcher useful during personal grooming that is collapsible or otherwise adapted for storing as a smaller unit. The catcher includes a bag comprising a closed bottom, closed side walls and a top and further includes a support member that is attached to the side walls to form a support configuration. The support configuration supports the bag under the face of the user. The support member may include a support strap adapted for passing behind the neck of the user. The catcher may further include one or more hinges attached to a top periphery of the bag so that in the open position the hinge holds the top of the bag open for receiving facial hair trimmings. The bag may be held open by a flexible tension member extending around a top periphery as a frame or disposed as a frame for the side walls.

8 Claims, 3 Drawing Sheets

FACIAL HAIR TRIMMINGS CATCHER

BACKGROUND OF THE INVENTION

1. Field of the Invention

The present invention is directed to flexible containers and more specifically, to a collapsible device for catching facial hair trimmings.

2. Description of the Related Art

Many men prefer to wear mustaches or beards and well-groomed men keep their facial hair trimmed and neat in appearance. Self-grooming is generally accomplished using scissors and a mirror. Since mirrors are widely available in bathrooms, typically mounted above a sink, men often use these bathroom mirrors to trim their mustaches or beards and use the sink to catch the trimmings. These trimmings cause untidy conditions in and around the sink and/or contribute to clogged drains.

Devices have been invented that catch facial hair, but these devices are generally bulky, uncomfortable to wear, and difficult or inconvenient to store. For example, U.S. Pat. No. 6,401,246 discloses a device having a neck band that encircles the entire neck and a cape assembly that is large and bulky. Consumers generally prefer hygiene-related products that can be conveniently stored in a small package and that are not difficult to use and store, especially those products that are only used occasionally.

What is needed is a device for catching facial hair trimmings that is easily worn by a person grooming a beard or mustache and that further provides easy removal and disposal of hair trimmings. It would be an advantage for such a device to be relatively light in weight and comfortable to wear and use and further be small enough to store conveniently.

SUMMARY OF THE INVENTION

The present invention provides devices useful during personal grooming for catching facial hair trimmings that are collapsible or otherwise adapted for storing in a smaller form than the size of the form that would be convenient for use. A particular embodiment of the present invention includes a bag comprising a closed bottom, closed side walls and a top. The bag is preferably formed of a flexible material that may be natural, synthetic or combinations thereof and suitably the flexible material may be a fabric. The catcher further includes a support member attached to the side walls to form a support configuration, wherein the support configuration is adapted for supporting the bag below the face of the user. The support member may be selected from clips, clasps, hook-and-loop fasteners, straps, laces, collars or combinations thereof. In particular embodiments, the support member may include a support strap extending between and attached to opposing side walls to form the support configuration, wherein the support configuration is adapted for passing the strap behind the neck of a user.

Additionally, the catcher may include one or more hinges having an open position and a closed position and attached to a top periphery of the bag so that in the open position the hinge holds the top of the bag open for receiving facial hair trimmings. Preferably, a spring is mounted in each of the one or more hinges that biases the hinge towards the open position.

Additional embodiments of the present invention include a bag that is held open by a flexible tension member extending around a top periphery as a frame. The frame forms an open configuration for receiving the facial hair clippings. Advantageously, the flexible tension member makes the catcher collapsible by twisting and folding the flexible tension member into a plurality of smaller forms to form a smaller unit for storing. Then, upon release, the tension member expands into the open configuration.

The tension member may be held securely in place by a pocket formed around the top periphery. The pocket may be formed by sewing, adhesives or fasteners selected from staples, brads or hook-and-loop fasteners or combinations thereof.

Additional embodiments of the present invention include a bag that is held open by a flexible tension member forming a frame for the side walls. These embodiments include a flexible tension member extending between opposing side walls to form a support configuration. The support configuration is adapted for passing the flexible tension member behind the neck of a user and for supporting the bag below the face of the user.

The flexible tension member further includes opposing ends that form a frame for each of the side walls, thereby making the catcher collapsible by twisting and folding the flexible tension member into a plurality of smaller forms to form a smaller unit for storing. Upon release, the tension member expands into the support configuration for use.

The frames formed by the tension member for the side walls may comprise a loop formed at each of the opposing ends of the tension member and preferably, the loop is closed. A pocket formed in a periphery of each of the sidewalls securely holds the sidewall frame formed by the tension member.

The foregoing and other objects, features and advantages of the invention will be apparent from the following more particular description of a preferred embodiment of the invention, as illustrated in the accompanying drawing wherein like reference numbers represent like parts of the invention.

BRIEF DESCRIPTION OF THE DRAWINGS

So that the above recited features and advantages of the present invention can be understood in detail, a more particular description of the invention, briefly summarized above, may be had by reference to the embodiments that are illustrated in the appended drawings. However, the appended drawings illustrate only typical embodiments of the invention and do not limit its scope as the invention may admit to other equally effective embodiments. The drawings are designed to illustrate the configuration of the structures and their positions and interaction, and the relative thickness, length or proximity may be exaggerated for purposes of better communicating structure, function, movement or interaction.

DETAILED DESCRIPTION OF EMBODIMENTS OF THE INVENTION

Figure 1:
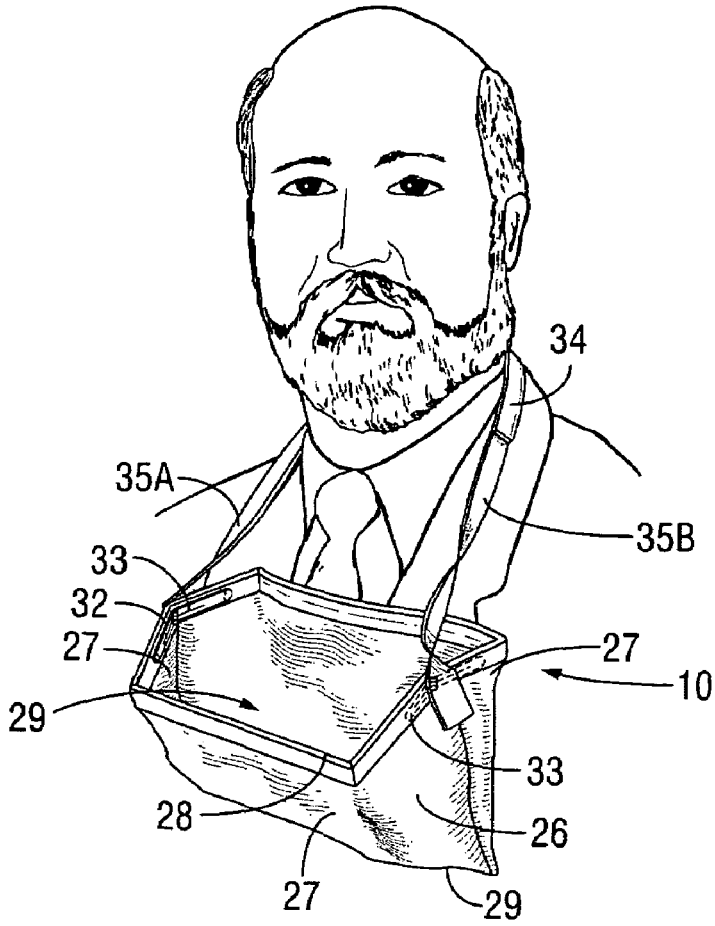
FIG. 1 is a perspective view of one exemplary embodiment of a facial hair trimmings catcher that includes a hinge to provide an open configuration in accordance with the present invention.

The present invention provides devices useful during personal grooming for catching facial hair trimmings that are collapsible or otherwise adapted for storing in a smaller form than the size of the form that would be convenient for use. The facial hair trimmings catcher is adapted for being secured by the neck and/or upper torso of the user. Particular embodiments of the device include a bag made of a flexible, resilient fabric that is suspended in a generally horizontal position underneath and about the face of the user for catching trimmed facial hair.

The bag may be of any convenient shape including, for example, cubical, rectangular, conical or cylindrical. Particular embodiments of the present invention include a bag of any shape having a closed bottom, closed side walls and a top that is open when in use for catching trimmed facial hair. The bottom and side walls may be closed, for example, by sewing or gluing the seams together or alternatively, the bag may be formed from a single piece of material or fabric so that closing seams is not required.

The bag may be made of any suitable flexible material, including both synthetic and natural materials. In particular embodiments, the bag is made of a flexible material so that the bag readily conforms to the shape of the user's upper anterior torso or neck to close gaps through which facial hair trimmings may fall and escape the bag. The flexible material may be porous, but the pore sizes are preferably small enough to prevent trimmings from passing through the material. Furthermore, the flexible material is preferably light and may also be of a color that contrasts with the color of common facial hair to make trimmings more visible. Suitable materials for the bag include, for example, cotton, nylon, silk, polyester, polyethylene and combinations thereof. Most fabrics, comprising natural materials, synthetic materials or combinations thereof are suitable materials for the bag as known to one having ordinary skill in the art.

The bag is supported in a generally horizontal position underneath and about the face of the user by a support member that is attached to the bag, including support members formed as a part of the bag. The support member may be selected from a variety of devices that include, but are not limited to, clips, clasps, hook-and-loop fasteners, straps, laces, or collars. The bag is adapted for being supportably secured to the upper torso or neck of the user by the support member. For example, clips may be used to clip the bag to a shirt of the user. Alternatively, a support strap may be used to loop behind the neck of the user by either passing the looped strap over the head of the user or by securing opposing ends of straps around the user's neck using, for example, a hook-and-loop fastener.

Particular embodiments of the present invention may include such further alternatives as, for example, a support member having a loop or a pair of extending flexible legs, similar to the temples on a pair of glasses or to the retaining legs on a choker, and having a defined space therebetween for inserting around the user's neck. This type of support member may be used by pulling the legs apart by a sufficient distance to allow the user's neck to be inserted therebetween and then allowing the legs to return to their original position positions to support the bag around the neck of the user.

The support member may be attached to the bag by any suitable methods known to one having ordinary skill in the art including, for example, sewing, gluing, or fastening by using suitable fasteners such as hook-and-loop fasteners, brads or staples. The support member may be attached to the bag by forming the support member, such as a strap, as a part of the bag so that mechanical attachment of the support member to the bag is not required.

FIG. 1 is a perspective view of one exemplary embodiment of a facial hair trimmings catcher that includes a hinge to provide an open configuration in accordance with the present invention. The facial hair trimmings catcher 10 includes a bag 26 having a bottom 29, side walls 27 and a top 28. The catcher 10 further includes a support strap 35 A,B attached to the opposing sides 27 of the bag 26. The support strap 35 A,B is adapted for passing the strap behind the neck of the user and for supporting the bag 26 under the face of the user so that trimmed facial hair falls into the open top 28 of the bag 26. In the illustrated embodiment of FIG. 1, the support strap 35 A,B comprises two separate straps 35A, 35B attached to opposing sides of the bag 26, joined together near the back of the neck of the user with a hook-and-loop fastener 34.

Particular embodiments of the present invention may include one or more hinges attached to the periphery of the top of the bag for holding the top of the bag open for receiving facial hair trimmings. The hinges may comprise a biasing member for biasing the hinge toward one of two stable positions, the open and the closed positions. The hinges may be made of metal, plastic, other suitable materials or combinations thereof. Typically, although not limiting, the biasing members are springs made of steel spring wire. The hinges may be sewn onto the top perimeter or otherwise attached to the perimeter with adhesives or fasteners.

The open position of the hinge is characterized by the hinge legs that are attached to the perimeter of the bag being typically from about 20 to about 180 degrees apart and preferably from between about 60 to 110 degrees apart. In the closed position, the hinge legs are adjacent one to the other with about 0 degrees apart. The biasing of the hinge holds the hinge in the position in which it is placed by the user. The open configuration provides for opening the top of the bag for optimal catching of trimmed facial hair while the closed configuration minimizes the size of the facial hair catcher for convenient storage.

In the embodiment illustrated in FIG. 1, the exemplary embodiment includes a pair of hinges 33 attached to opposite sides of the bag 26. The hinges 33 are shown in the open position to hold the top 28 of the bag 26 in an open position for receiving facial hair trimmings. The hinges 33 further include a spring 32 mounted in each of the hinges 33 so that the spring 32 biases the hinge 33 towards the open position for receiving the trimmings.

Figure 2:
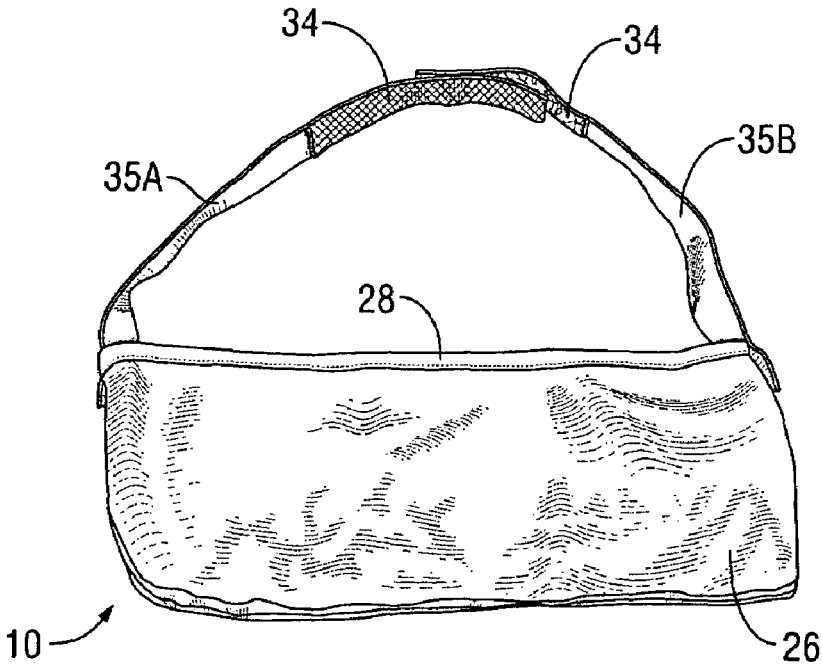
FIG. 2 is a perspective view of the exemplary embodiment of the facial hair trimmings catcher illustrated in FIG. 1 in its closed configuration.
Figure 3:
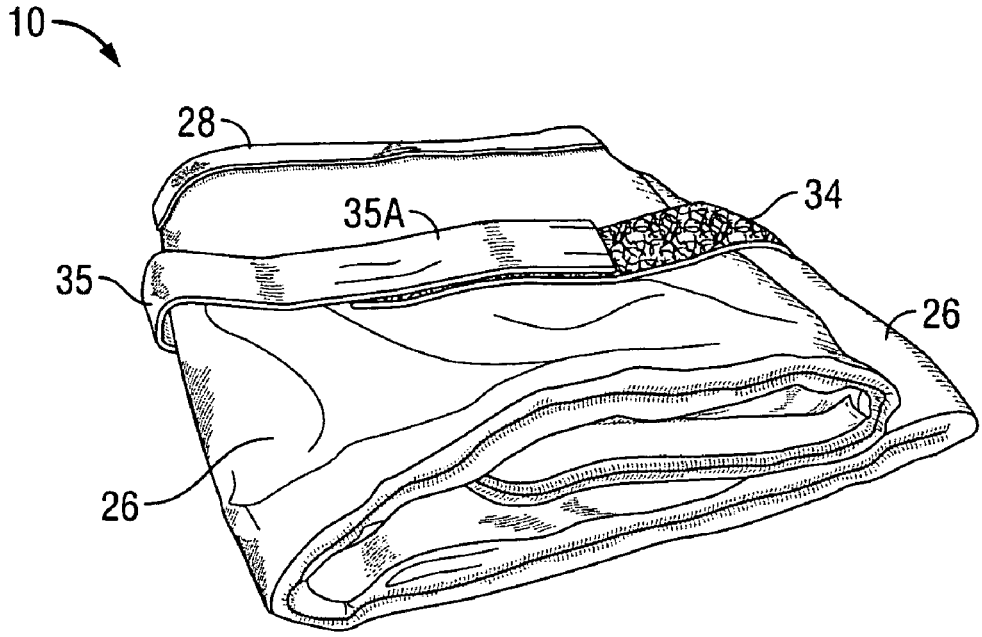
FIG. 3 is a perspective view of the catcher illustrated in FIG. 1 in its folded configuration for convenient storage.

FIG. 2 is a perspective view of the exemplary embodiment of the facial hair trimmings catcher illustrated in FIG. 1 in its closed configuration. The hinges 33 (See FIG. 1) are in the closed position and the top 28 of the bag 26 is closed. FIG. 3 is a perspective view of the catcher illustrated in FIG. 1 in its folded configuration for convenient storage. The closed hinges 33 allow the bag 26 to fold flat, and the hinges 33 fold within approximately a third of the bag 26 so that the facial hair catcher 10 may be folded to approximately one-third of its opened size for storage.

Particular embodiments of the present invention may include a bag with a support member as disclosed above but alternatively, instead of the hinges, include a flexible tension member disposed around the top periphery of the bag as a frame to form the open configuration of the top of the bag for receiving facial hair clippings. The tension member may be attached around the periphery of the bag by sewing the tension member in place or by using fasteners, such as staples or brads, to attach the tension member to the periphery. In particular embodiments of the present invention, a pocket is formed around the periphery by, for example, folding a piece of the flexible material forming the bag over and then hemming to form the pocket. Alternatively, a second strip of flexible material may be attached to the top of the bag to form the pocket. The pocket may be formed, for example, by sewing, adhesives, fasteners selected from staples, brads or hook-and-loop fasteners or combinations thereof. The pocket then is used to securely hold the flexible tension member.

The tension member normally assumes the shape of the frame for holding the top of the bag open in the open configuration for use as a facial hair trimmings catcher. However, the tension member is adapted for being collapsed by twisting and folding the tension member into a plurality of substantially concentric smaller forms to form a smaller unit for storing. Upon release, the flexible tension member expands into the open configuration for use as a trimmings catcher. The flexible tension member may be made of any suitable springing material that can be bent repeatedly and recover its original shape when released. For example, but without limitation, spring steel, springy polymeric materials or bamboo fibers may be suitable for use as materials for the flexible tension member.

Figure 4:
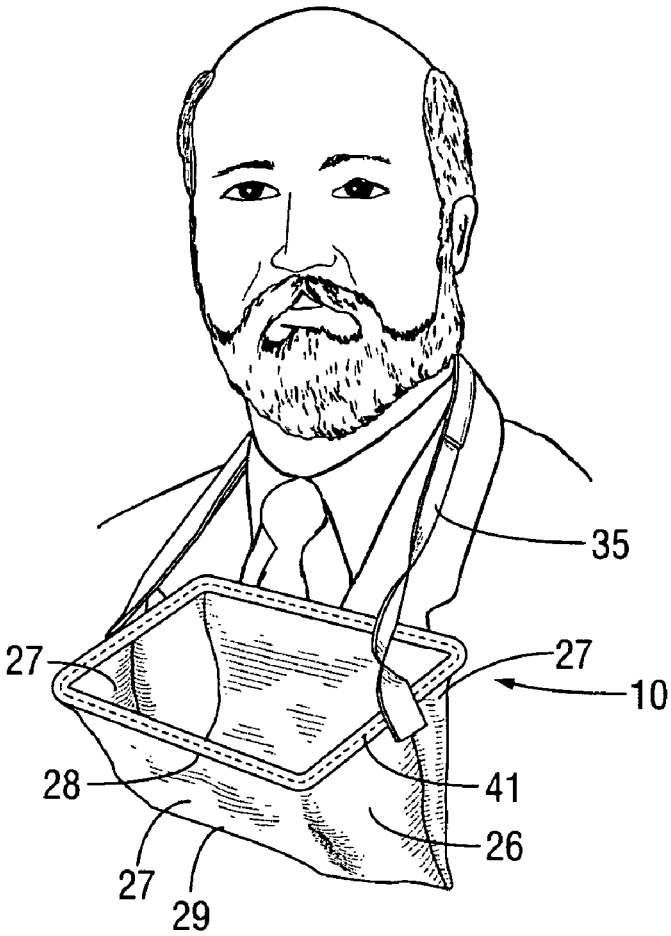
FIG. 4 is a perspective view of one exemplary embodiment of a facial hair trimmings catcher that includes a flexible tension member disposed about the top perimeter to provide an open configuration in accordance with the present invention.

FIG. 4 is a perspective view of one exemplary embodiment of a facial hair trimmings catcher that includes a flexible tension member disposed about the top perimeter to provide an open configuration in accordance with the present invention. The facial hair trimmings catcher 10 includes a bag 26 having a closed bottom 29, closed side walls 27 and a top 28 as well as a support strap. The top 28 of the bag 26 is held open by a flexible tension member 41 that is disposed about the perimeter of the top 28. The flexible tension member 41, which is made of spring steel, holds the top 28 open when the facial hair catcher 10 is supported below the face of the user.

Figure 5:
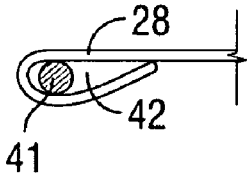
FIG. 5 is a cross sectional view of the top perimeter of the exemplary embodiment illustrated in FIG. 4.
Figure 6:
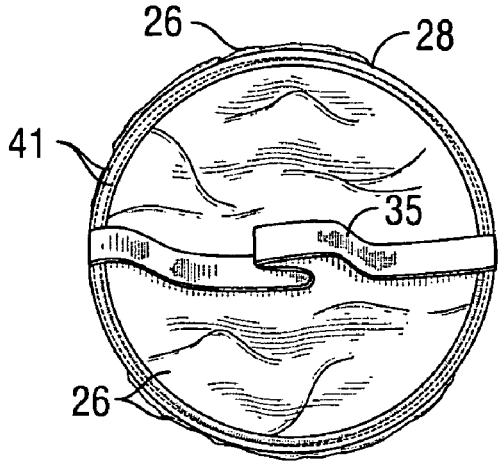
FIG. 6 is a perspective view of the catcher illustrated in FIG. 4 in its collapsed configuration for convenient storage.

FIG. 5 is a cross sectional view of the top perimeter of the exemplary embodiment illustrated in FIG. 4. The flexible tension member 41 is held in place around the top perimeter of the bag 26 by a pocket 42 formed by folding over a piece of the top 28 of the bag 26 to form the pocket 42 and sewing or otherwise fastening the material together. FIG. 6 is a perspective view of the catcher illustrated in FIG. 4 in its collapsed configuration for convenient storage after twisting and folding the tension member 41 into a plurality of substantially concentric smaller forms to form a smaller unit for storing.

Particular embodiments of the present invention may further include a bag with a support member as disclosed above but alternatively, instead of the hinges or a frame disposed about the top periphery as disclosed above, may include a flexible tension member extending between opposing side walls to form a support configuration as well as a frame for the side walls. In these embodiments, the flexible tension member provides both the frame for holding the bag in an open position as well as the support that passes behind the neck of a user for supporting the bag below the face of the user.

Advantageously, the tension member provides a collapsible facial hair trimmings collector since the collector may be collapsed by twisting and folding the flexible tension member into a plurality of substantially concentric smaller forms to form a smaller unit for storing. Upon release, the tension member expands into the support configuration for use.

Figure 7:
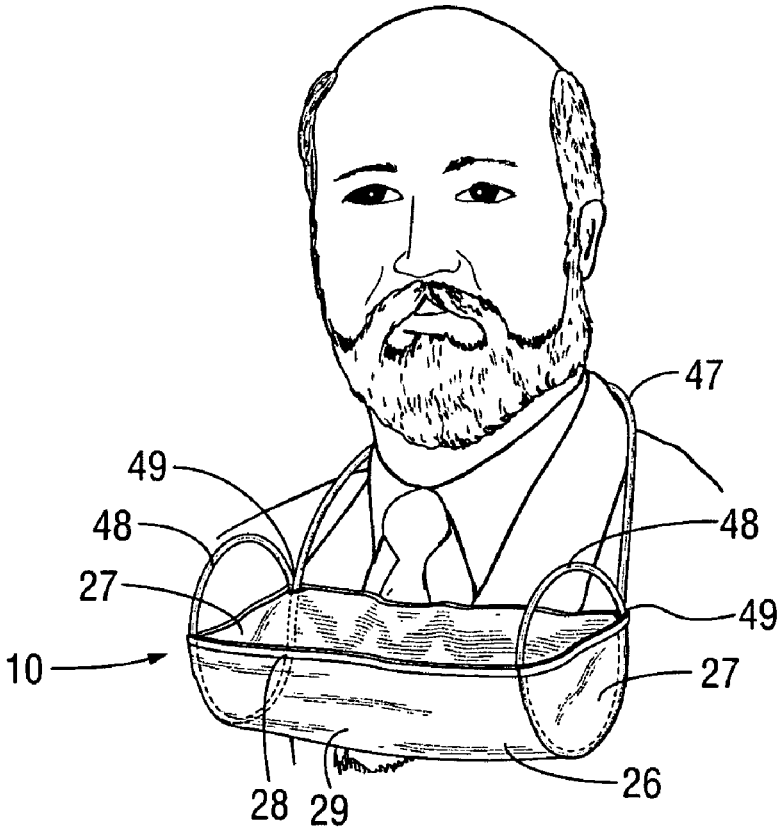
FIG. 7 is a perspective view of one exemplary embodiment of a facial hair trimmings catcher that includes a flexible tension member as a side wall frame to provide an open configuration in accordance with the present invention.

FIG. 7 is a perspective view of one exemplary embodiment of a facial hair trimmings catcher that includes a flexible tension member as a side wall frame to provide an open configuration in accordance with the present invention. The facial hair trimmings catcher 10 includes a bag 26 having a closed bottom 29, closed side walls 27 and a top 28. In the exemplary embodiment, the flexible tension member 47 extends between opposing side walls 27 to form the support that passes behind the neck of the user and thereby supports the bag 26 below the face of the user.

Additionally, the flexible tension member 47 further forms a frame for each of the side walls 27 for holding the bag 26 open during use. In particular embodiments, the frame is formed by forming a loop 48 in each of the opposing ends of the tension member 47. Preferably, the loop 48 is a closed by attaching the opposing ends 49 of the tension member to the tension member 47 itself. The opposing ends 49 may be attached to the tension member 47 by soldering, welding or brazing or by using clips, fasteners or other mechanical devices known to one having ordinary skill in the art.

The tension member 47 may be attached to the side walls 27 by the same methods used to attach the tension member to the top periphery as disclosed above.

The terms "comprising," "including," and "having," as used in the claims and specification herein, shall be considered as indicating an open group that may include other elements not specified. The term "consisting essentially of," as used in the claims and specification herein, shall be considered as indicating a partially open group that may include other elements not specified, so long as those other elements do not materially alter the basic and novel characteristics of the claimed invention. The terms "a," "an," and the singular forms of words shall be taken to include the plural form of the same words, such that the terms mean that one or more of something is provided. For example, the phrase "a solution comprising a phosphorus-containing compound" should be read to describe a solution having one or more phosphorus-containing compound. The terms "at least one" and "one or more" are used interchangeably. The term "one" or "single" shall be used to indicate that one and only one of something is intended. Similarly, other specific integer values, such as "two," are used when a specific number of things is intended. The terms "preferably," "preferred," "prefer," "optionally," "may," and similar terms are used to indicate that an item, condition or step being referred to is an optional (not required) feature of the invention.

It should be understood from the foregoing description that various modifications and changes may be made in the preferred embodiments of the present invention without departing from its true spirit. The foregoing description is provided for the purpose of illustration only and should not be construed in a limiting sense. The scope of the invention is limited only by the language of the claims.

What is claimed is:

1. A facial hair trimmings catcher, comprising:

a bag comprising a closed bottom, closed side walls and a top, wherein the bag is formed of flexible and porous material, said porous material having a plurality of pores each sized such that facial hair trimmings do not escape from said bag;

wherein said flexible and porous material includes a color that contrasts with a color of said facial hair trimmings such that said facial hair trimmings are more visible;

a support member attached to the side walls to form a support configuration, wherein the support configuration is adapted for supporting the bag below the face of the user;

a flexible tension member extending around a top periphery to form an open configuration for receiving facial hair clippings, wherein the facial hair trimmings catcher is collapsible by twisting and folding the flexible tension member into a plurality of smaller forms to form a smaller unit for storing and wherein the tension member expands into the open configuration upon release.

2. The catcher of claim 1, wherein the support member is selected from clips, clasps, hook-and-loop fasteners, straps, laces, collars or combinations thereof.

3. The catcher of claim 1, wherein the support member comprises a support strap extending between and attached to opposing side walls to form the support configuration, wherein the support configuration is adapted for passing the strap behind the neck of a user.

4. The catcher of claim 1, further comprising:

a pocket formed around the top periphery to securely hold the tension member.

5. The catcher of claim 4, wherein the pocket is formed by sewing, adhesives or fasteners selected from staples, brads or book-and-loop fasteners or combinations thereof.

6. A facial hair trimmings catcher, comprising:

a bag comprising a closed bottom, closed side walls and a top, wherein the bag is formed of flexible and porous material, said porous material having a plurality of pores each sized such that facial hair trimmings do not escape from said bag;

wherein said flexible and porous material includes a color that contrasts with a color of said facial hair trimmings such that said facial hair trimmings are more visible;

a support member attached to the side walls to form a support configuration, wherein the support configuration is adapted for supporting the bag below the face of the user;

a flexible tension member extending around a top periphery to form an open configuration for receiving facial hair clippings, wherein the facial hair trimmings catcher is collapsible by twisting and folding the flexible tension member into a plurality of smaller forms to form a smaller unit for storing and wherein the tension member expands Into the open configuration upon release; and wherein the support member includes a pair of extending flexible legs defining a space therebetween for inserting around a user's neck.

7. The catcher of claim 6, wherein the support member is selected from clips, clasps, hook-and-loop fasteners, straps, laces, collars or combinations thereof.

8. The catcher of claim 6, further comprising: a pocket formed around the top periphery to securely hold the tension member.

* * * * *